US008821052B2

(12) United States Patent
Yamaguchi

(10) Patent No.: US 8,821,052 B2
(45) Date of Patent: Sep. 2, 2014

(54) CUTTING DEVICE AND RECORDING APPARATUS

(75) Inventor: Toshiaki Yamaguchi, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 257 days.

(21) Appl. No.: 13/012,659

(22) Filed: Jan. 24, 2011

(65) Prior Publication Data

US 2011/0182645 A1 Jul. 28, 2011

(30) Foreign Application Priority Data

Jan. 26, 2010 (JP) ..... 2010-014498

(51) Int. Cl.

| | |
|---|---|
| ***B41J 13/24*** | (2006.01) |
| ***B41J 11/70*** | (2006.01) |
| ***B26D 7/02*** | (2006.01) |
| ***B26D 1/24*** | (2006.01) |
| *B26D 7/01* | (2006.01) |

(52) U.S. Cl.

CPC ..... *B41J 11/706* (2013.01); *B26D 7/018* (2013.01); *B26D 7/025* (2013.01); *B26D 1/245* (2013.01)

USPC ..... 400/621; 83/282; 83/378; 83/383

(58) Field of Classification Search

USPC ..... 400/21, 583; 83/383, 384, 385, 483, 83/614, 14, 268, 207, 396, 453, 454, 460, 83/428, 206, 262, 282, 378, 375, 379

See application file for complete search history.

(56) References Cited

U.S. PATENT DOCUMENTS

| | | | | |
|---|---|---|---|---|
| 5,791,218 | A * | 8/1998 | Saito et al. | 83/92 |
| 5,911,530 | A * | 6/1999 | Hinojosa et al. | 400/621 |
| 6,916,132 | B2 * | 7/2005 | Otsuka et al. | 400/621 |
| 2005/0051011 | A1 | 3/2005 | Onishi | |

FOREIGN PATENT DOCUMENTS

| | | | |
|---|---|---|---|
| JP | 08-192388 | A | 7/1996 |
| JP | 2000-108333 | A | 4/2000 |
| JP | 2002-226108 | A | 8/2002 |
| JP | 2003-072054 | A | 3/2003 |
| JP | 2004-090131 | A | 3/2004 |
| JP | 2005-014095 | A | 1/2005 |
| JP | 2008-036961 | A | 2/2008 |
| JP | 2009-214200 | A | 9/2009 |

* cited by examiner

*Primary Examiner* — Matthew G Marini

(74) *Attorney, Agent, or Firm* — Canon U.S.A., Inc. IP Division

(57) ABSTRACT

A cutting device includes a conveyance unit for conveying a recording medium in a conveyance direction, a guide configured to guide a recording medium, a blade movable in a direction intersecting with the conveyance direction, for cutting the recording medium when the blade moves with a leading end side thereof inclined to the upstream side, a presser member movable to a first position where the presser member holds down the recording medium and to a second position where the presser member does not hold down the recording medium, wherein the presser member holds down the recording medium at a position separated farther than a thickness of the recording medium from the guide in the first position, and wherein the presser member holds down the recording medium at least from before the blade starts to cut the recording medium to when the blade is cutting the recording medium.

20 Claims, 7 Drawing Sheets

CUTTING DEVICE AND RECORDING APPARATUS

BACKGROUND OF THE INVENTION

1. Field of the Invention

The present invention relates to a cutting device for cutting a recording medium, and a recording apparatus including the cutting device.

2. Description of the Related Art

Conventionally, in a recording apparatus configured to record images on the recording medium such as a roll of sheet, a recording medium cutting device is mounted, and after an image is recorded on a recording medium based on image information, the cutting device cuts the recording medium at a desired position in a conveyance direction of the recording medium, and a recorded medium is discharged as an output object in final form.

A cutting device is well known in which a cutter unit, which moves transversely across the discharge port, is located near a discharge port for discharging a recorded medium, and by moving the cutter, the recording medium is cut. In the above configuration, when a recording medium is cut, since the cutter unit is moved in a direction perpendicular to the conveyance direction, a problem arises that the recording medium is displaced by being subjected to a force from the cutter during cutting.

To prevent a recording medium from being displaced during cutting, Japanese Patent Application Laid-Open No. 2005-14095 discusses a configuration in which a member is provided that holds the recording medium just before it is cut.

In recording apparatuses in recent years, the recording area is widened to realize a further increase in speed, and the discharge direction length on the downstream side of the cutter unit is shorter to downsize the main body. In order to greatly accelerate a recording speed in an inkjet recording apparatus, a possible solution to the above requirement is to enlarge a recording area for one line, in other words, to make the recording head wider in the conveyance direction. As a result, the conveyance-direction area of the platen becomes longer and the distance from the conveyance rollers for conveying and holding a recording medium to the cutter unit become longer.

Since a curl formed in a roll of paper (paper curl) remains in a sheet of paper being conveyed, if the distance between the conveyance rollers and the cutter unit is long, the paper tends to be lifted up by the paper curl therebetween. If the carriage carrying the recording head is made larger as the recording head increases in size, the distance between the platen configured to absorb and support a recording medium and the cutter unit becomes longer, and the amount of uplift becomes larger all the more because there is no means that restrains the uplift of the paper therebetween.

To shorten the depth of the whole apparatus including a storage unit for recorded and discharged recording media, it is arranged so that a recording medium is not discharged in the horizontal direction, but discharged downward in the vertical direction as much as possible. Therefore, before cutting, the portion of the recording medium which is on the downstream side in the conveyance direction of the cutter unit sags downward, but the portion on the upstream side lifts up notably in an arc form about the cutter unit as the fulcrum.

In a case of a cutter where it cuts a recording medium while a flat blade or rotary circular blades thereof are moving, the blades are mounted slightly inclined from the blade moving direction to the upstream side (to the fixed blade or the cutter guide rail side) in the conveyance direction of the recording medium. For this reason, the recording medium is pulled to the downstream side of the conveyance direction by the moving blades during cutting.

Therefore, if a cutting action starts while the recording medium is lifted up in the air on the upstream side of the cutter unit, the uplift of the recording medium is eliminated during cutting, and the cutting position on the recording medium is displaced, so that the recording medium cannot be cut to be straight. As a countermeasure, it may be possible to hold the recording medium in the manner discussed in Japanese Patent Application Laid-Open No. 2005-14095, but the surface of the recording medium may be damaged.

SUMMARY OF THE INVENTION

According to an aspect of the present invention, a cutting device restrains a shift of a cutting position on a recording medium.

According to another aspect of the present invention, a cutting device includes a conveyance unit configured to convey a recording medium in a conveyance direction, a guide to guide a recording medium conveyed by the conveyance unit, a blade movable in a direction perpendicular to the conveyance direction on the downstream side of a conveyance direction of the guide, the blade being able to cut the recording medium when the blade moves with a leading end side thereof inclined close to the upstream side of the conveyance direction, a presser member movable to a first position where the presser member holds down an end portion on a cutting start side of the recording medium and to a second position where the presser member is separated from the recording medium on the upstream side in the conveyance direction of the blade. The presser member holds down the recording medium at a position more distant than a thickness of the recording medium from the guide in the first position. The presser member holds down the recording medium at least from before the blade starts to cut the recording medium to when cutting in progress.

According to another aspect of the present invention, a cutting device can be provided which can prevent a shift of a cutting position on a recording medium.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the various features of the present invention.

DETAILED DESCRIPTION OF THE EMBODIMENTS

Various exemplary embodiments, features, and aspects of the invention will be described in detail below with reference to the drawings.

Figure 1A:
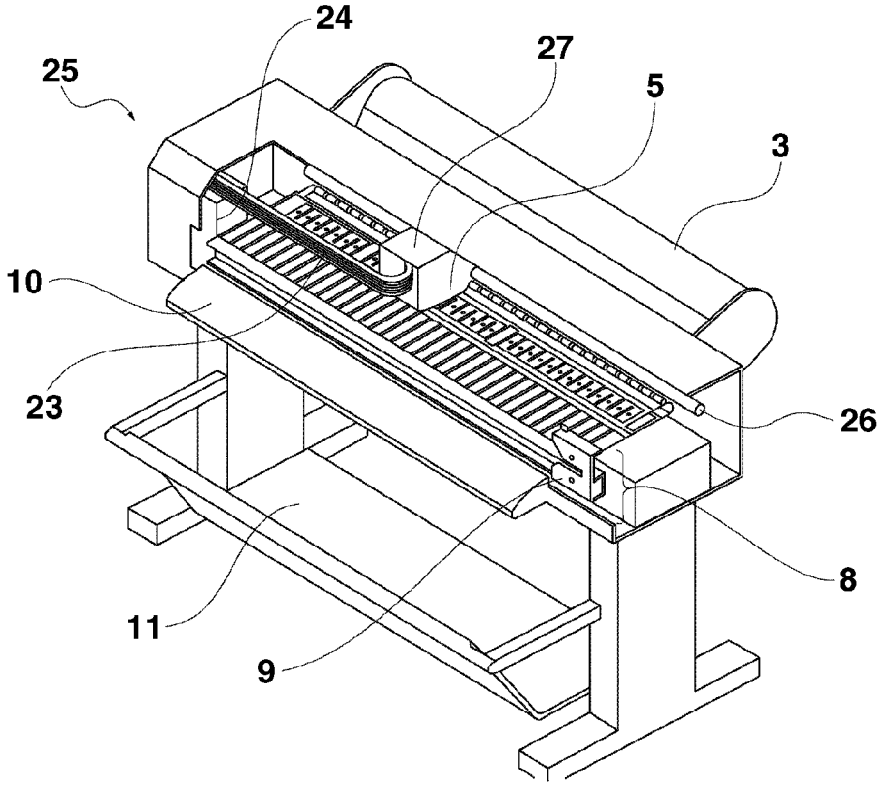
FIGS. 1A and 1B are a perspective view and an enlarged view of main sections of an inkjet recording apparatus according to a first exemplary embodiment and a second exemplary embodiment of the present invention.
Figure 1B:
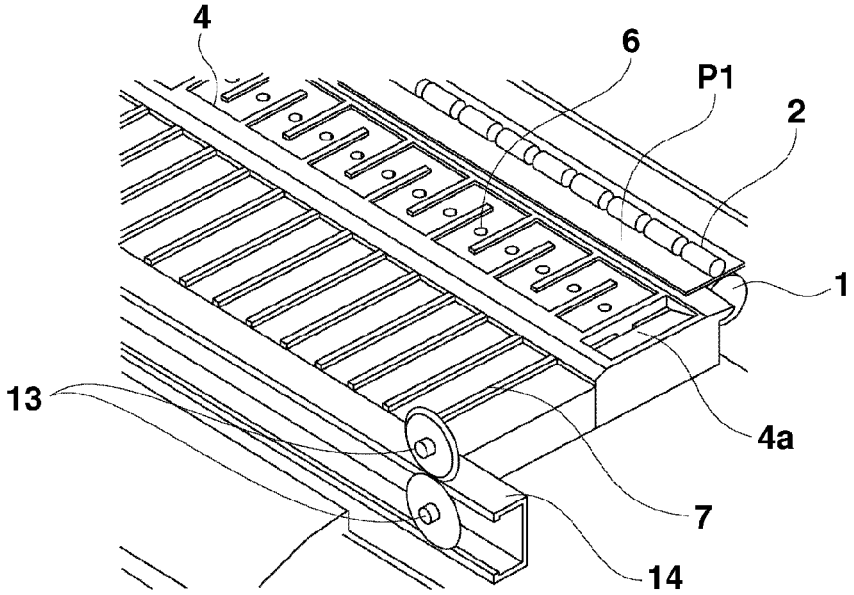

FIG. 1A is a perspective view of an inkjet recording apparatus according to an exemplary embodiment of the present invention, and FIG. 1B is a perspective view, on an enlarged scale, of an area from conveyance rollers to the cutting device.

A rolled recording medium supply unit 3 contains a roll of recording medium, such as recording paper, wound on a core tube. In an inkjet recording apparatus according to the present exemplary embodiment, a recording medium P1 supplied from a roll of recording medium in the rolled medium supply unit 3 is conveyed in a conveyance direction by a conveyance roller 1 and a pinch roller 2, and further conveyed to a platen 4, which serves as a conveyance guide for the recording medium. An image is printed by the recording head 5 on an upper surface of the recording medium P1 conveyed to the platen 4.

Suction holes 6 connected to a negative pressure generating unit (not illustrated) are provided in a platen 4 located opposing to the recording head 5. As the air between the platen 4 and the recording medium P1 is suctioned through the suction hole 6, the recording medium P1 is stuck to the platen 4 and is prevented from being lifted therefrom.

A conveyance surface 7 as a guide to guide the recording medium P1 up to the cutting device 8 is provided on the downstream side of the platen 4. A recorded portion of the recording medium P1 is guided by the conveyance surface 7 on the downstream side of the platen 4, passing through the cutter unit 9, and guided downward by a discharge guide 10 arranged near the downstream side of the cutter unit 9.

The recorded recording medium P1 is conveyed to a desired position to be cut at its rear end, and is cut by a pair of rotary circular blades 13 provided on the cutter unit 9. The cut image-recorded portion of the recording medium P1 is guided downward by the discharge guide 10 to drop and stored in a storage unit 11.

The cutter unit including a presser member 12 will be described with reference to FIGS. 2 to 5C. The cutter unit 9 includes rotary circular blades 13 to cut a recording medium and a holder unit to retain the rotary circular blades 13. The rotary circular blades 13 are moved by a belt (not illustrated) in a direction perpendicular to the conveyance direction of a recording medium.

Figure 2:
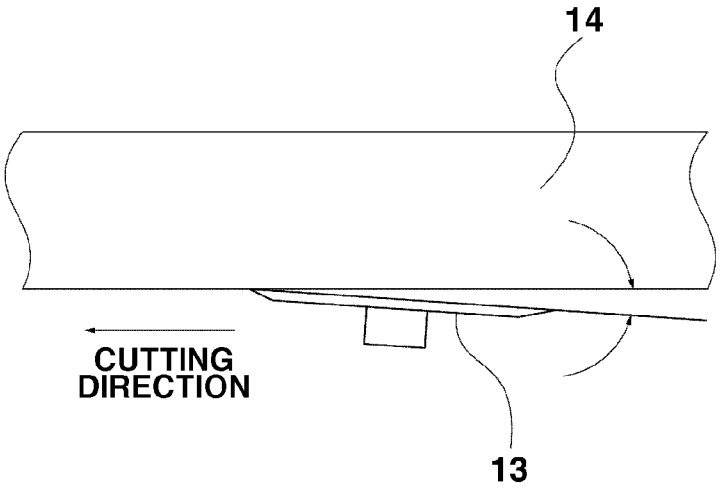
FIG. 2 illustrates a posture of rotary circular blades mounted in a cutting device according to the first and second exemplary embodiments.

To improve a movement linearity of the cutter unit 9, as illustrated in FIG. 2, the rotary circular blades 13 are mounted in such a manner that a leading end side thereof in a blade moving direction during cutting is slightly inclined with respect to the cutter guide rail 14 toward the upstream side (on the cutter guide rail side) in the recording medium conveyance direction.

Therefore, the cutter unit 9 can move steadily as the cutter unit 9 receives a force in a direction in which it is pressed to the guide rail 14 while it is cutting a recording medium P1. On the other hand, the recording medium P1 is cut in a state where the recording medium is not lifted in the air while the recording medium P1 is pulled to the downstream side of the conveyance direction.

Figure 3A:
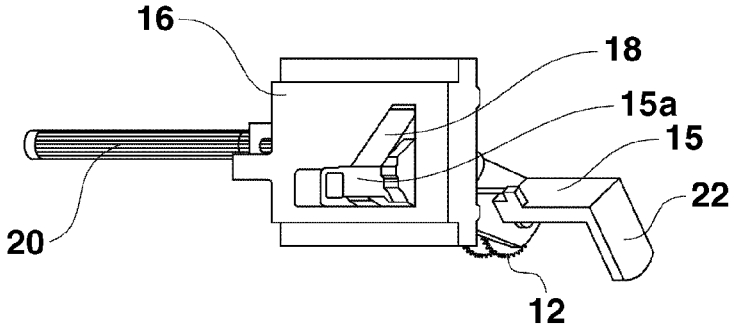
FIGS. 3A and 3B illustrate a state where a presser member is sufficiently separated from a recording medium according to the first exemplary embodiment.
Figure 3B:
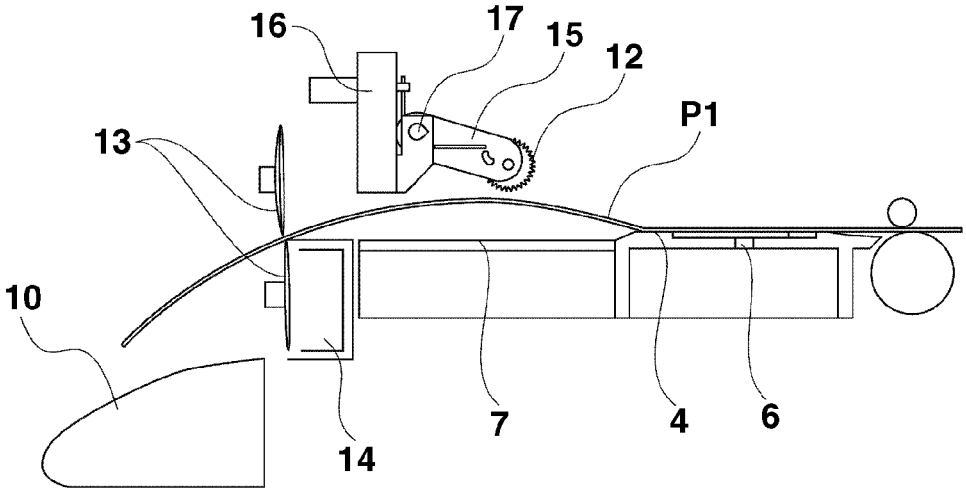
Figure 4A:
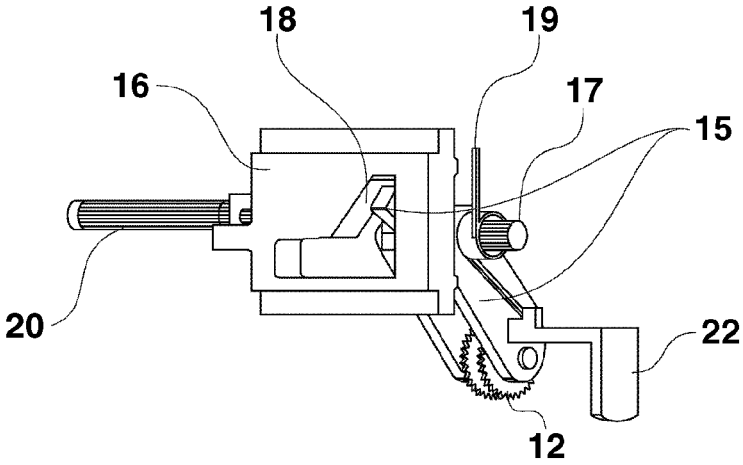
FIGS. 4A and 4B illustrate a state where the presser member presses the recording medium according to the first exemplary embodiment.
Figure 4B:
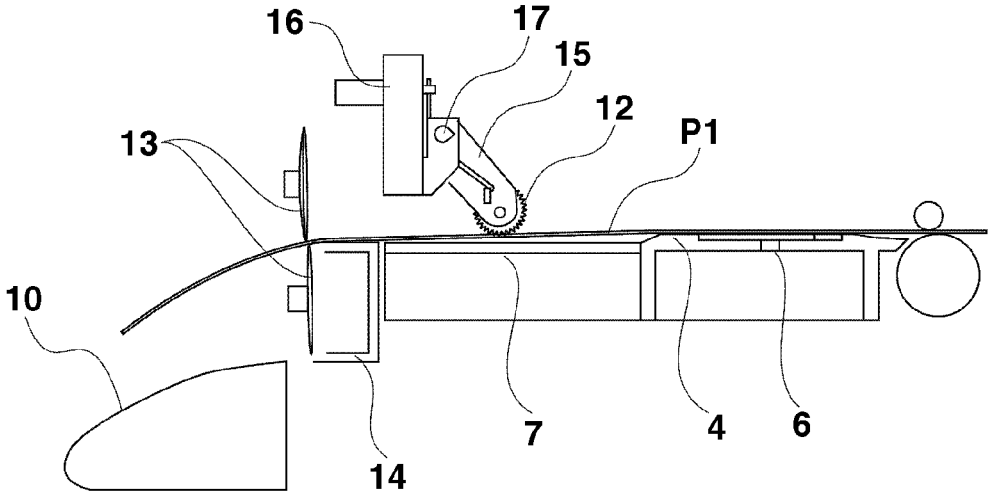

FIGS. 3A, 3B, 4A, and 4B illustrate a configuration in which the presser member 12 is linked with the cutter unit 9. FIGS. 3A and 3B each illustrate a state in which the presser member 12 is in a second position sufficiently separated from the recording medium while the recording operation is performed. FIGS. 4A and 4B each illustrate a state in which the presser member 12 is in a first position at which the presser member 12 holds down the recording medium P1 not to allow it to be lifted in the air when a cutting operation has started. FIG. 3A and FIG. 4A each illustrate a mechanism by which the presser member 12 operates. FIG. 3B and FIG. 4B each illustrate the position of the presser member 12 and the posture of the recording medium P1 as viewed from the side of the printer main body.

The presser member 12 to prevent the uplift of the recording medium P1 is mounted to a holder member 15 as a support part in such a manner that the presser member 12 can swing about a spindle 17. As the holder member 15 pivots about the spindle 17, the presser member 12 can moves between the first position where the presser member 12 holds down the recording medium P1 and the second position where the presser member 12 is separated from the recording medium P1 and does not press the medium.

The holder member 15 is urged by a holder spring 19 to turn in a clockwise direction as illustrated in FIG. 3B, in other words, in a direction for the presser member 12 to hold down the recording medium. The presser member 12 is a spur-shaped rotating body having a plurality of projections formed on its outer periphery to contact the recording medium, and the presser member 12 is rotatably supported at one end of the holder member 15.

A slider member 16 serves as a cam with a cam surface 18. The slider member 16 is supported by a slider guide 30, illustrated in FIGS. 5A to 5C, movable in parallel with the moving direction of the cutter unit 9.

The holder member 15 is an arm-like member, and the other end portion 15*a* of the holder member 15, which is opposite to one end portion with which the presser member 12 is attached, servers as a cam follower configured to contact the cam surface 18 formed on the slider member 16. As the slider member 16 moves along the slider guide 30, the cam surface 18 formed on the slider member 16 turns the holder member 15.

In FIGS. 3A and 3B, the slider member 16 is located at a standby position (at the right end in FIGS. 1A and 1B) of the cutter unit 9, and the cam surface 18 pushes down the end portion 15*a* of the holder member 15 against the urging force of the holder spring 19, and the presser member 12 is at a position separated from the recording medium P1.

The slider member 16 is urged to the center side of the cutting device by a slider spring 20, and as described below, the slider member 16 slides in parallel with the moving direction of the cutter unit 9 as the cutter unit 9 operates. In other words, when the cutter unit 9 moves in the cutting direction from the state illustrated in FIGS. 3A and 3B, the slider member 16 is moved horizontally for a predetermined amount by the slider spring 20.

Urged by the urging force of the holder spring 19, the end portion 15*a* of the holder member 15 rises while sliding on the moving cam surface 18, and the presser member 12 moves to the position where it holds down the recording medium P1.

The height of the presser member 12 in the state where the presser member 12 holds down the recording medium P1 is determined by a height regulating rib 22 provided on the holder member 15 by contacting the recording medium conveyance surface 7. The rib 22 at that time is arranged so as to be outside of the end portion of the width direction of the recording medium P1 and in contact with the recording-medium conveyance surface 7.

At this time, the recording medium P1 is not held between the recording medium conveyance surface 7 and the presser member 12, and the distance between the recording medium conveyance surface 7 and the presser member 12 is larger than the thickness of the recording medium P1.

The recording medium P1 tends to be lifted up by a repulsion force due to the paper curl. Therefore, the urging force of the holder spring 19 is set at such a level as to prevent the presser member 12 from rising by a force from the recording medium P1 due to the repulsion force of the recording medium P1.

Figure 5A:
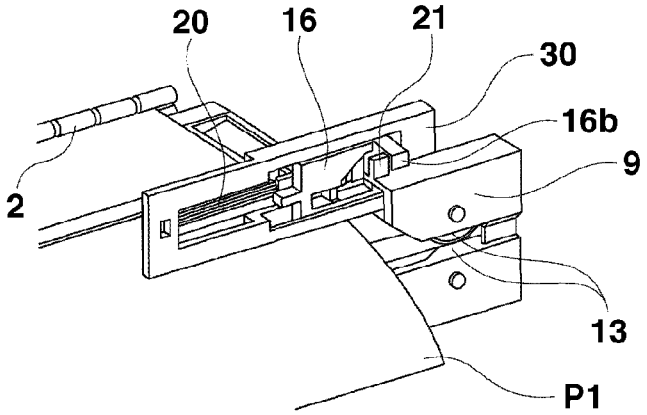
FIGS. 5A to 5C illustrate relations between a movement of the cutter unit and the presser member according to the first exemplary embodiment.

The operation of the cutter unit 9 and the operation of the presser member 12 will be described with reference to FIGS. 5A to 5C. FIG. 5A illustrates the cutter unit 9 at rest in standby position, FIG. 5B illustrates the state of the cutter unit 9 from it has started to move and before it cuts the recording medium P1, and FIG. 5C illustrates the cutter unit 9 that is cutting the recording medium P1.

As illustrated in FIG. 5A, when the cutter unit 9 is in the initial standby position, the cutter unit 9 is at rest with a rib 21 thereof in engagement with a protrusion 16*a* formed on the slider member 16.

At this time, the slider member 16 is urged in a direction toward the center of the printer by the slider spring 20, but the slider member 16 is prevented from moving by its engagement with the rib 21 of the cutter unit 9. The presser member 12 is at rest in a position separated from the recording medium P1.

Figure 5B:
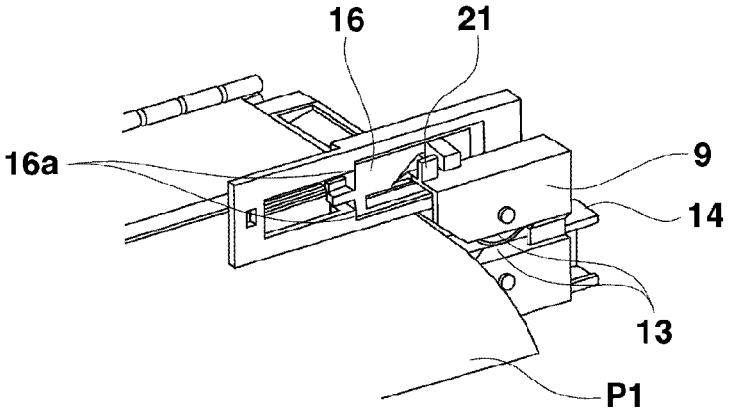
Figure 5C:
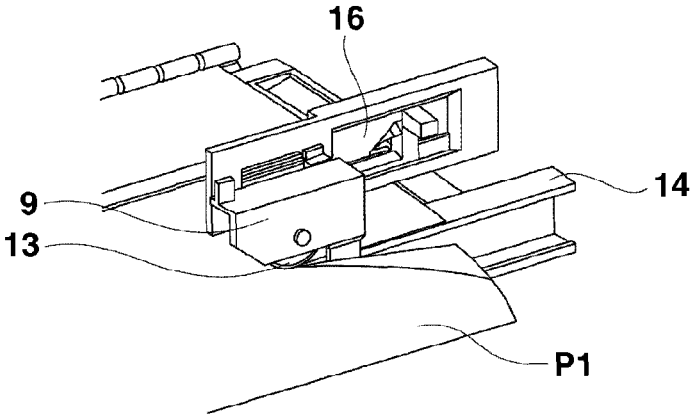

As illustrated in FIG. 5B, when the cutter unit 9 starts to move, the slider member 16 is made to slide by the slider spring 20, and then comes into contact with the slider stopper 16*a* and stops. The end portion 15*a* of the holder member 15 slides on the moving cam surface 18, causing the holder member 15 to turn, so that the presser member 12 moves to the first position where the presser member 12 holds down the recording medium P1 not to allow it to be lifted in the air. The movement of the presser member 12 to the first position occurs just before the circular blades 13 start to cut the recording medium P1.

Then, as illustrated in FIG. 5C, the rotary circular blades 13 mounted in the cutter unit 9 start to cut the recording medium P1 which is prevented from being lifted in the air. As described above, the leading end portions of the rotary circular blades 13, which are on the downstream side of the blade traveling direction, are inclined toward the upstream side in the recording medium conveyance direction. Therefore, while the rotary circular blades 13 are cutting the recording medium P1, the recording medium P1 is pulled in the medium conveyance direction and is prevented from being lifted up in the air. The presser member 12 stays at the first position at least during a period from before a start of cutting and during cutting.

Figure 7:
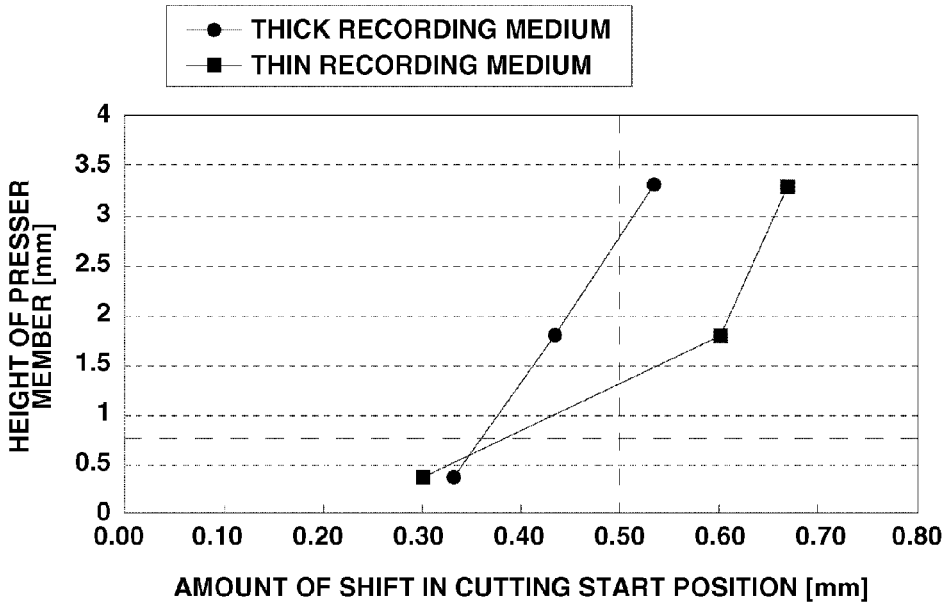
FIG. 7 is a graph illustrating a relation between a height of the presser member and an amount of shift of a cutting position.

The height of the presser member and the amount of shift in the cutting position will be described. FIG. 7 is a graph obtained by experiments performed by using the configuration in the first exemplary embodiment, in which a vertical axis represents the height of the presser member and a horizontal axis represents the amount of shift in the cutting start position.

If less than 5 mm, which is supposed to be an amount unlikely to pose any problem for ordinary users, is adopted as a criterion for making a judgment of whether the above-mentioned amount of shift is allowable or not, by referring to the graph in FIG. 7, it has been confirmed that the height of the presser member (a distance from the conveyance surface 7 and the presser member 12) can be less than 2.7 mm in a case where a thin recording medium, such as plain paper, is used.

With a thick recording medium with high rigidity and strong curl, it has been confirmed that a presser member height can be less than 1.3 mm. On the other hand, as the presser member height is decreased, the presser member 12 is more likely to pinch a recording medium P1, and as a result the surface of the recording medium may become significantly scratched.

In this experiment, with a presser member height of less than 0.8 mm, visible scratches were observed. For this reason, an optimum presser height is 0.8 mm or more and less than 2.7 mm when only a thin recording medium is used. When a thick recording medium is used, by designing a presser member with a height of 0.8 mm or more and less than 1.3 mm, it could be confirmed that the linearity can be achieved from the start to the end of cutting without pinching the recording medium and reducing scratches on the surface of the recording medium.

A recording operation in the whole of an inkjet recording apparatus, including the above-mentioned cutting device, will be described. The conveyance roller 1, the pinch roller 2, the platen 4, and the cutting device 8 are arranged in this order in the conveyance direction of the recording medium P1, which has been conveyed from the rolled medium supply unit 3. The conveyance roller 1 and the pinch roller 2 convey a recording medium P1 that has conveyed through the conveyance path, to the image recording section.

The image recording section includes the platen 4 which vacuum-chucks and supports the recording medium P1, and the recording head 5 which is arranged opposing to the platen 4, moves in a main scanning direction as a sheet-width direction, and ejects the ink to record an image on the recording medium P1.

The recording head 5 has a plurality of ink-discharge nozzle arrays (not illustrated) on a surface thereof facing the recording medium P1. The nozzle arrays are arranged in a sub scanning direction, which is the recording medium conveyance direction. The recording head 5 is configured so that different nozzle arrays discharge different color inks. The nozzle arrays are supplied with corresponding color inks from an ink tank 24 through supply tubes.

A carriage 27 carrying the recording head 5 is supported to be slidable on a guide shaft 26 fixed at both ends to a frame of the printer main body 25. The carriage 27 can reciprocate on the guide shaft 26 by being driven by a motor and a belt drive unit, not illustrated.

On completing a printing operation for one scanning operation, the printing operation is suspended for a while, and conveys a recording medium P1 on the platen 4 for a predetermined length. After this, while moving the carriage 27 along the guide shaft 26, the image recording section prints for the next scanning operation, and repeats this procedure.

In this manner, while reciprocating the carriage 27, the recording head 5 discharges inks to record a desired image on the recording medium P1.

In ordinary recording by an inkjet recording apparatus, normally, margins are left around the periphery of a recording medium, but in some cases, an image is recorded without leaving margins. In each of recording with margins and recording without margins, a recording operation and an operation of the presser member mounted on the cutting device will be described.

Description will start with a recording operation without margins. To eliminate the margins in the width direction of the recording medium P1, ink is discharged in a wider range than the width of the recording medium, and the ink discharged outside the recording medium is received by the recessed areas 4*a* provided in the platen 4 beyond the width of the recording medium. On the other hand, to eliminate the margins at the leading end and the trailing end in the conveyance direction of the recording medium P1, recording without margins is performed by cutting off the leading end and the trailing end by the cutting device 8 to remove the margins.

In a recording operation without leaving margins at the leading end and the trailing end, recording is started by ejecting the ink from the recording head 5 to the recording medium P1, which has been conveyed, based on recorded image data. In the middle of recording, when the leading end of a recorded image has a little passed the cutting position of the cutting device 8, the recording operation is suspended, and the margin at the leading end is cut off by the cutter unit 9.

At this time, when the cutter unit 9 starts to move as described above, the slider member 16 makes a parallel movement, causing the holder to turn, and after the presser member 12 holds down the recording medium. P1 to inhibit it from being lifted in the air, the cutter unit 9 starts to cut the recording medium P1. At this time, the presser member 12 is holding down the surface of the recorded medium.

After the cutter unit 9 has moved to the width end of the recorded medium and finished cutting, the cutter unit 9 returns to the initial standby position. In the middle of returning to the standby position, the cutter unit 9 contacts the slider member 16, causing the slider member 16 to make a parallel movement due to the presence of the cutter unit 9, causing the holder member 15 to turn about the spindle 17, so that the presser member 12 is separated widely from the recording medium P1.

Subsequently, the recording apparatus starts a recording operation again and when it completes recording based on recording image data, the recording medium P1 is conveyed by the conveyance roller 1 to the trailing-end cutting position, and a margin portion at the trailing end is cut off. At this time, like when the leading-end margin is cut off, after the presser member 12 holds down the recording medium P1 in interlocking with the motion of the cutter unit 9, the cutter unit 9 starts to cut the recording medium P1. Since the recorded image is located on the downstream side in the conveyance direction from the cutting position, the presser member 12 is holding down the unrecorded surface of the medium.

After having reached the width end of the recorded medium and finished cutting, the cutter unit 9 again returns to the initial standby position. Before the cutter unit 9 returns to the standby position, to prepare for the next recording operation, the recording apparatus feeds back the conveyance roller 1 to rewind the recording medium P1.

The presser member 12, which is a spur-shaped rotating body, contacts the surface of a moving unrecorded recording medium, and is rotated. Due to this operation, the ink adhering in a very small quantity to the protrusions of the presser member 12 is cleaned when the margin at the leading end is cut off. Since the presser member 12 is rotated each time a recording operation is performed, it is possible to prevent an ink deposition which may result from a repetitive contact of the recorded surface with the same portion of the presser member 12.

After that, when the cutter unit 9 contacts the slider member 16, in the same manner as described above, the presser member 12 is separated widely from the recording-medium conveyance surface.

Next, a recording operation with margins will be described. When recording with margins remaining is performed, after a recording medium P1 is conveyed by the conveyance roller 1 to a state where a margin is provided in the leading end area of the recording medium P1. Therefore, the leading end of the recording medium need not be cut off during a recording operation.

Subsequently, after recording based on recording image data is completed, the recording medium P1 is conveyed by the conveyance roller 1 to a desired trailing end cutting position, and the recording medium P1 is cut off with a margin left at the training end of the image. At this time, the operation of the cutter unit 9, the presser member 12, and the recording medium P1 is the same as that in cutting the trailing end in recording without margins.

Therefore, in recording with margins, the presser member 12, a series of recording processes are finished without the presser member 12 contacting the recorded surface of the medium.

A second exemplary embodiment of the inkjet recording apparatus will be described.

The description starts with a configuration of the cutting device including the presser member 12 with reference to FIGS. 6A to 6D. The presser member 12 to prevent the uplift of the recording medium P1 is mounted to the holder member 15. As the holder member 15 rotates about the spindle 17, the presser member 12 reciprocates between a position where it holds down the recording medium P1 and a position where it is separated from the recording medium P1.

Figure 6A:
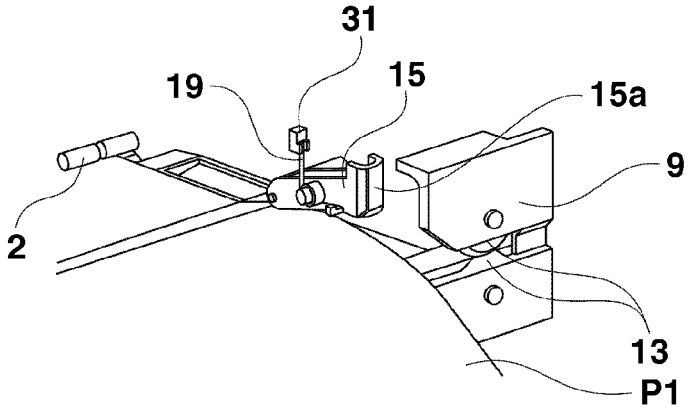
FIGS. 6A to 6D illustrate relations between a movement of the cutter unit and the presser member according to the second exemplary embodiment.

The holder member 15 is urged by the holder spring 19, and the holder spring 19 has its one end applied to the holder member 15, and the other end applied to a fixing element 31 of the printer main body. Therefore, when the cutter unit 9 is not in contact with holder cam surface 15*a*, the presser member 12 is at rest in a position widely separated from the recording medium P1 (FIG. 6A).

When the cutter unit 9 starts to move, a portion of the cutter unit 9 contacts the cam surface 15*a* of the holder member, the holder member 15 rotates about the spindle 17, and the presser member 12 holds down the recording medium P1.

The height of the presser member when the presser member 12 holds down a recording medium P1 is determined by the height regulating rib 22 on the holder member 15 by coming into contact with the recording-medium conveyance surface 7. The rib 22 at this time is arranged to be in contact with the recording-medium conveyance surface 7 in a position beyond the end portion in the width direction of the recording medium.

The operation of the cutter unit 9 and the operation of the presser member 12 will be described with reference to FIGS. 6A to 6D.

Figure 6B:
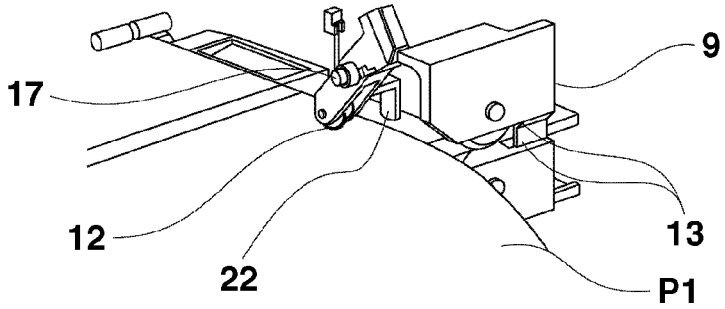
Figure 6C:
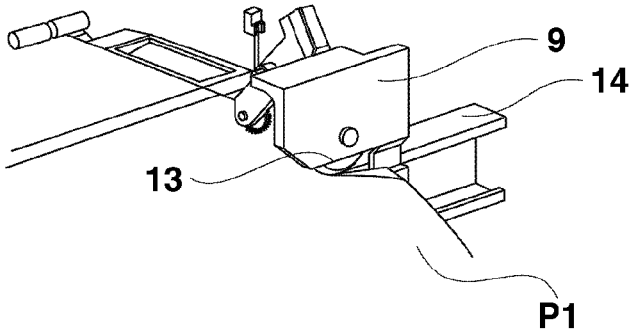
Figure 6D:
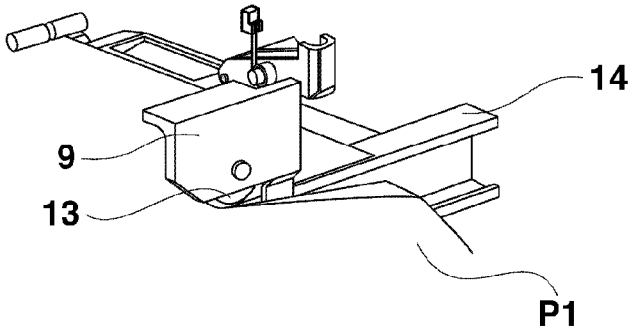

FIG. 6A illustrates the cutter unit 9 at rest in the initial standby position, FIG. 6B illustrates a state of a period when the cutter unit 9 has started to move and before it cuts the recording medium P1, and FIGS. 6C and 6D illustrate a state where the cutter unit 9 is cutting the recording medium P1.

As illustrated in FIG. 6A, while the cutter unit 9 is at rest in the initial standby position, the holder member 15 is caused to be at rest in a position separated from the recording medium P1 by the holder spring 19.

As illustrated in FIG. 6B, when the cutter unit 9 starts to move, the cutter unit 9 comes into contact at one point thereof with the cam surface 15*a* of the holder member 15, the holder member 15 rotates about the spindle 17, and the presser member 12 moves to a position where the presser member 12 holds down the recording medium P1 to prevent it from being lifted in the air.

As illustrated in FIG. 6C, the rotary circular blades 13 mounted on the cutter unit 9 start to cut the recording medium P1 which is prevented from being lifted in the air. When the cutter unit 9 has moved a predetermined amount, the cutter unit 9 comes free from the cam surface 15*a* of the holder member 15 as illustrated in FIG. 6D, and, the presser member 12 returns to a position separated from the recording medium P1.

In a configuration according to the second exemplary embodiment, the presser member 12 temporarily holds down the stationary recording medium P1 in a predetermined period when the cutter unit 9 starts to cut the recording medium P1. Therefore, the range where the presser member 12 contacts the recording medium P1 can be minimized, and chances are reduced for scratches or a faint image transfer to occur on the recording medium P1.

In a case where recording without margins is not performed, since cutting of a margin at the leading end of sheet does not occur, there is no chance that the presser member 12 contacts the recorded area. Therefore, since the recording medium is not scratched, and the ink is not adhered to and is not deposited on the recording medium, the presser member 12 can be brought close to the recording-medium conveyance surface 7, so that a shift in the cutting position can be improved.

Compared with the first exemplary embodiment, the inkjet recording apparatus according the second exemplary embodiment is different in the configuration, including the cutter unit 9 and the holder member 15 with the presser member 12, but the other configuration and the whole of the recording operation are the same as those in the first exemplary embodiment.

In the second exemplary embodiment, the cam surface is formed on the holder member, but the cam surface can be formed on the cutter unit so that the blades and the cam may be moved together, and a cam follower may be formed on the holder member to move the presser member.

In the foregoing exemplary embodiments, since the cutter unit can starts cutting in the state where the recording medium is prevented from being lifted in the air, the recording medium can be cut without uplift from beginning to end of cutting. As a result, the recording medium can be inhibited from shifting from a right cutting position by being displaced during a cutting operation from beginning to end, and the cutting performance can be improved.

For a period when the cutter unit does not move (during a recording operation, for example), since the presser member is separated widely from the recording-medium conveyance surface, the recording operation and the recording medium are not affected by the uplift phenomenon. While the recording medium is held down, since the recording medium is not pinched, the recording medium is less likely to be scraped and recording quality can be prevented from deteriorating.

When a thin star-pointed spur-shape rotary disk is used for the presser member, effects of cleaning the spur-shape rotary disk can be obtained during recording without margins. When recording without margins is performed, a margin at the leading end of sheet may be eliminated by suspending recording after the leading end portion of the recording medium has been printed for a predetermined range, and cutting off the leading-end margin of the recording medium including the leading end portion of the image.

Subsequently, after the rest of the recording operation is resumed and then finished, the margin at the trailing end of the recording medium including the trailing end portion of the image are cut off. Thus, the margin of the trailing end is eliminated. For this reason, while the margin in the leading end is being cut off, the presser member holds down the recorded area of the recording medium, and during this period, when the ink just after recording is more likely to be transferred, a very small amount of ink may adhere to the spur disk.

Each time recording without margins is performed, if the same portion of the spur disk mounted on the presser member repeatedly contacts the recorded area, a very small amount of ink adheres and is deposited to the spur disk, and the deposited ink on the spur may be re-transferred to a recording medium at some future time, which results in a loss of recording quality. To prevent this problem, after the cutter unit moves in one direction and cuts a recording medium, for a period until the cutter unit returns to the initial standby position, the spur disk of the presser member is made to be in contact with the recording medium.

While the cutter unit returns to the initial standby position, if the recording medium is rewound by the conveyance roller to prepare to start the next recording operation, the spur disk holding down a blank portion of a margin at the trailing end is rotated as the recording medium is rewound, and the spur cleaning effects can be obtained. Further, when the margin at the leading end is cut off, the recorded surface is prevented from being contacted by the same portion of the spur disk at each recording.

Since the presser member temporarily presses the recording medium at rest for a predetermined period when the cutter unit starts cutting, the range where the presser member contacts the recording medium can be reduced to a minimum, and abrasion or re-transfer to the recording medium can be reduced. Particularly in a recording apparatus in which recording without margins is not performed, since cutting off of the margin at the leading end is not performed, the presser member does not contact the recorded area.

Because of the absence of the scratches to the recording area, and the adhesion and deposition of ink to the recording medium, the presser member can be made to descend close to the recording-medium conveyance surface to suppress the sheet uplift, the shift in the cutting position can be improved.

In the foregoing exemplary embodiments, though the rotary circular blades are used for the cutter unit, a knife-like blade may be used.

In the foregoing exemplary embodiments, the spur-shaped roller is used for the presser member, but a driven roller which is rotated by a recording medium may be used. Alternatively, a resin or metal presser having a form that can guide a sheet may be used.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-014498 filed Jan. 26, 2010, which is hereby incorporated by reference herein in its entirety.

What is claimed is:

1. A cutting device comprising:

a conveyance unit configured to convey a recording medium in a conveyance direction;

a guide configured to guide the recording medium conveyed by the conveyance unit;

a blade configured to cut the recording medium when the blade moves;

a member disposed upstream in the conveyance direction of the blade, movable to a first position, and to a second position where the member is separated from the recording medium; and an arm shape member configured to support the member at one end thereof, and has at other end a cam follower, the arm shape member pivoting about a spindle according to a cam so that the member moves alternately to the first position and to the second position, wherein the first position is closer to the guide than the second position, and wherein the member is in the first position to regulate the recording medium at least from before the blade starts to cut the recording medium to when the blade is cutting the recording medium.

2. The cutting device according to claim 1, further comprising a spring, wherein the cam is moved by the spring, and wherein as the cam is moved by the spring, the member is caused to move to the first position.

3. The cutting device according to claim 2, further comprising a holder unit configured to hold the blade, wherein as the holder unit moves in a direction intersecting with the conveyance direction, the blade cuts the recording medium, and when moving toward a standby position, the holder unit causes the cam to move against an urging force of the spring to move the member to the second position.

4. The cutting device according to claim 1, further comprising a holder unit configured to hold the blade, wherein as the holder unit moves in a direction intersecting with the conveyance direction, the blade cuts the recording medium, and when moving toward a standby position, the holder unit causes the cam to move against an urging force of the spring to move the member to the second position.

5. The cutting device according to claim 1, wherein the arm shape member has a contact member, and when the member has moved to the first position, as the contact member comes into contact at one point thereof with the guide, the member is kept at a position farther than the thickness of the recording medium from the guide.

6. The cutting device according to claim 1, wherein a pressing force of the member is larger than a force received from the recording medium due to a curl of the recording medium.

7. The cutting device according to claim 1, wherein the member is a spur-shaped rotary body with a plurality of protrusions formed around a periphery thereof to contact a recording medium.

8. The cutting device according to claim 1, wherein the member is a driven roller.

9. The cutting device according to claim 1, wherein the member is a guide made of resin or metal.

10. The cutting device according to claim 1, wherein the cam and the blade move together.

11. A recording apparatus, comprising:

a recording unit configured to perform recording on a recording medium; and a cutting device according to claim 1, wherein after the recording unit performs recording on a recording medium, the recording medium is cut by the cutting device.

12. The recording apparatus according to claim 11, further comprising a discharge guide provided adjacent to the downstream side of the conveyance-direction of the cutting device, and guides a recording medium downward after the recording unit performs recording on a front surface of the recording medium between the conveyance unit and the cutting device.

13. A recording apparatus comprising:

a recording unit configured to perform recording on a recording medium; and a cutting device according to claim 7, wherein after the recording unit performs recording on a recording member, the recording medium is cut by the cutting device, and after the cutting, while the member is kept at the first position, the conveyance unit conveys the recording medium in a direction opposite to the conveyance direction.

14. The cutting device according to claim 1, wherein the member is located at the first position at least from before the blade starts to cut the recording medium to when the blade is cutting the recording medium.

15. A cutting device comprising:

a conveyance unit configured to convey a recording medium in a conveyance direction;

a holder unit configured to hold a blade downstream in the conveyance direction, wherein as the holder unit moves in a direction intersecting with the conveyance direction, the blade cuts the recording medium;

a presser member configured to hold down the recording medium on the upstream side of the conveyance direction of the blade;

a support unit configured to support the presser member movable to a first position where the presser member holds down the recording medium and to a second position where the presser member does not hold down the recording member; and a cam configured to move the presser member, wherein the cam is moved by a spring to move the presser member to the first position, and the cam is moved by the holder unit in a direction opposite to a moving direction in which the cam is moved by the spring to move the presser member to the second position, and wherein the presser member holds down the recording member at least from before the blade starts to cut the recording medium to when the blade is cutting the recording medium.

16. The cutting device according to claim 15, wherein the cam moves the support unit so that the presser member moves to the first position and the second position.

17. The cutting device according to claim 16, wherein the support unit includes an arm shape member configured to pivot about a spindle, and wherein the arm shape member supports the presser member at one end thereof and has at other end a cam follower in contact with the cam.

18. The cutting device according to claim 15, wherein, when moving toward a standby position, the holder unit causes the cam to move against an urging force of the spring to move the presser member to the second position.

19. The cutting device according to claim 15, further comprising a guide configured to guide the recording medium conveyed by the conveyance unit, wherein, when the presser member holds down the recording medium in the first position, a distance between the presser member and the guide is larger than a thickness of the recording medium.

20. The cutting device according to claim 19, wherein, when the presser member moves to the first position, a part of the support unit contacts the guide to maintain the distance between the presser member and the guide to be larger than the thickness of the recording medium.

* * * * *